US006367231B1

(12) United States Patent
Yamamoto

(10) Patent No.: US 6,367,231 B1
(45) Date of Patent: Apr. 9, 2002

(54) METHOD AND APPARATUS FOR CASTING A CARD INTO A FOLDABLE CASE

(75) Inventor: Kaoru Yamamoto, Kyoto (JP)

(73) Assignee: Kyoto Seisakusho Co., Ltd., Kyoto (JP)

( * ) Notice: Subject to any disclaimer, the term of this patent is extended or adjusted under 35 U.S.C. 154(b) by 0 days.

(21) Appl. No.: 09/611,455

(22) Filed: Jul. 7, 2000

(30) Foreign Application Priority Data

Mar. 30, 2000 (JP) ..... 2000-094480

(51) Int. Cl.[7] ..... B65B 7/26

(52) U.S. Cl. ..... 53/469; 53/467; 53/473; 53/266.1

(58) Field of Search ..... 53/457, 492, 381.1, 53/381.6, 386.1, 473, 469, 266.1, 467

(56) References Cited

U.S. PATENT DOCUMENTS 4,201,027 A 5/1980 Ilsemann
4,685,277 A * 8/1987 Ilsemann ..... 53/474
4,852,327 A 8/1989 Kurkowski et al.
4,934,892 A * 6/1990 Smith et al. ..... 53/286
5,285,620 A 2/1994 Kaye et al.
5,341,624 A 8/1994 Kaye
5,479,760 A 1/1996 Petrell
5,664,405 A 9/1997 Perego
5,788,114 A 8/1998 Perego
5,816,028 A 10/1998 Zaniboni
5,943,845 A * 8/1999 Ilsemann ..... 53/468
6,048,158 A * 4/2000 Zaniboni ..... 53/468

FOREIGN PATENT DOCUMENTS

JP 2001-48118 2/2001

* cited by examiner

*Primary Examiner*—John Sipos
*Assistant Examiner*—Gloria R. Weeks
(74) *Attorney, Agent, or Firm*—W. F. Fasse; W. G. Fasse

(57) ABSTRACT

A card casting machine casts or throws a card B into a case 10, such as an optical disk case, having a pair of case bodies 11*a* and 11*b* openable via a hinge 15. The card casting machine includes a case closing device 2 to close the case 10 from an open condition by lifting both case bodies 11*a* and 11*b* of the case 10 placed on a support table 16, and a card casting device 4 to cast the card B into the case 10 during the closing operation when an open angle α of the case 10 is an acute angle.

14 Claims, 6 Drawing Sheets

METHOD AND APPARATUS FOR CASTING A CARD INTO A FOLDABLE CASE

BACKGROUND OF THE INVENTION

The present invention relates to the field of automated packaging, and more specifically, to a method of or an apparatus for casting or throwing a card into a foldable plastic case for an optical disk such as CD (i.e. Compact Disk), DVD (i.e. Digital Video Disk) or the like.

Generally, a case for an optical disk has a box-shaped case body foldable via a hinge. An optical disk is loaded into one side of the case body and a card is inserted into the other side of the case body. On the front face of the case body is provided a cover for inserting a title sheet.

Conventionally, as there were no automated packaging machines to load an optical disk and insert a card and a title sheet into a case, these loading and inserting operations were performed by hand, which was very troublesome.

The solution to this problem is identified in Onishi, Japanese patent application No. 11-217277, published on Feb. 20, 2001 as JP 2001-48118A. As shown in Onishi, an automated optical disk loading machine is provided where loading of an optical disk and insertion of a title sheet and a card can be automatically conducted.

In operation, as a case conveyor conveys a plurality of cases, an optical disk loading device loads an optical disk into a case, a title sheet inserting device inserts a title sheet into the cover of a case, and a card casting device casts or throws a card into a case.

In casting a card into the case, a card is cast or thrown into the case that is placed in a fully developed condition.

Thus, at the time of casting a card in the aforementioned machine, a card sometimes slips out of the case, and the slipped card is sandwiched or pinched between the case bodies at the time of folding the case. Also, a card sometimes crosses over the hinge and the card is bent at the time of folding the case. As a result, stable casting of a card into the case cannot be conducted.

The main object of the present invention is to provide a method or an apparatus to cast a card into a case stably and securely.

SUMMARY OF THE INVENTION

The present invention is directed to a method of or an apparatus for casting a card into a case having a pair of case bodies openable and closable via a hinge.

The method of casting a card includes the steps comprising:

(i) closing the case by lifting the case bodies of the case placed in a developed condition.

(ii) casting a card into the case when an open angle of the case is an acute angle during the process of closing the case.

The apparatus for casting a card into a case includes a case closing device to close the case by lifting the case bodies of the case placed on a table in a developed condition. The apparatus also includes a card casting device to cast a card into the case when an open angle of the case is an acute angle during operation of the case closing device.

Preferably, a card to be cast into a case stands by at the position where the tip of the card is inserted into and placed inside the case closed at the acute angle.

In the card casting method of the present invention, a card is cast or thrown into a case when an open angle of the case is an acute angle during the process of closing the case.

That is to say, at the time of casting a card, a case is opened in a V-shaped form. A card cast into the case falls down toward the hinge via its self weight and is inserted into the case. Thus, an inserted card is prevented from crossing over both the case bodies and being bent at the time of folding the case. Moreover, a card insertion space having V-shaped cross section in the case is narrower as it goes toward the bottom or the hinge, which prevents the card inserted into the case from slipping out of the case and also prevents the card from being sandwiched or pinched between the case bodies at the time of folding the case. In such away, a card can be stably and securely cast and inserted into the case.

In the card casting machine of the present invention, a case closing device closes a case, and when the case is closed at an acute open angle, a card casting device casts a card into the case.

At the time of casting a card, a case is opened in a V-shaped form, that is, a case is formed with a card insertion space of V-shaped cross section. Thus, an inserted card is prevented from crossing over both the case bodies and being bent at the time of folding the case. Moreover, the card cast into the case is prevented from slipping out of the case and also prevented from being sandwiched between the case bodies at the time of folding the case. In such a manner, a card can be stably and securely cast and inserted into the case.

In addition, when a card to be cast stands by at the position where the tip of the card is disposed inside the case closing at the acute angle, "mis-casting" of a card into the case can be prevented, and the card can be more securely cast into the case.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 4:
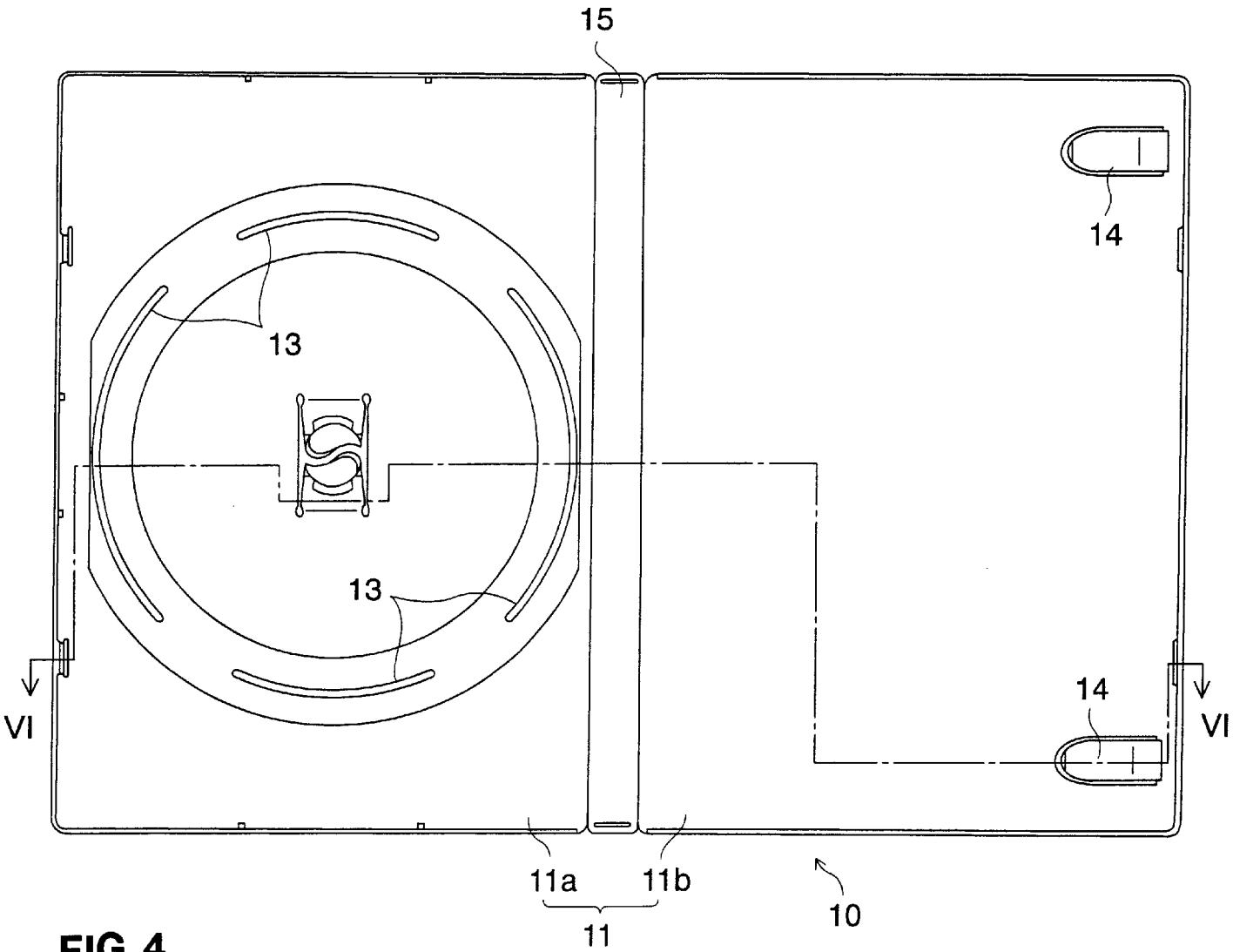
FIG. 4 is a top plan view of a case in a developed condition.
Figure 5:
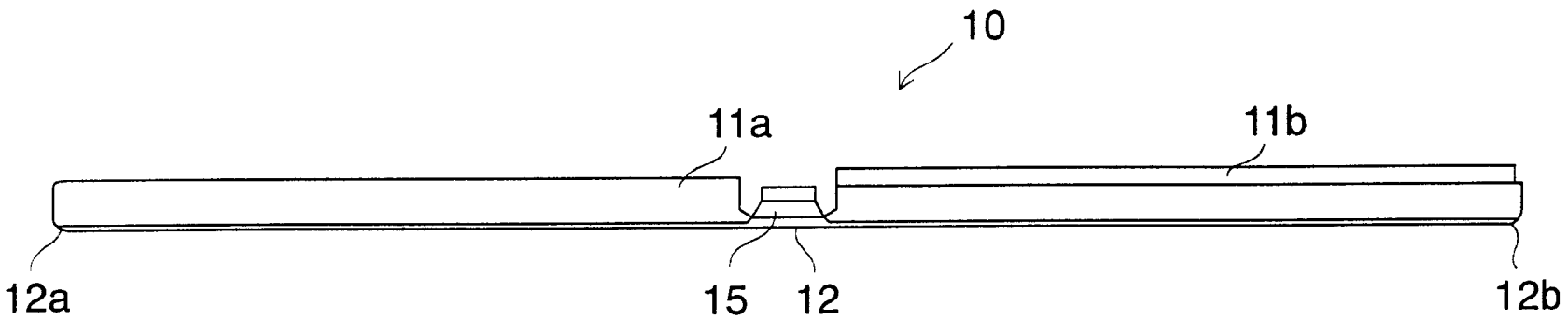
FIG. 5 is a side view of a case in a developed condition.
Figure 6:
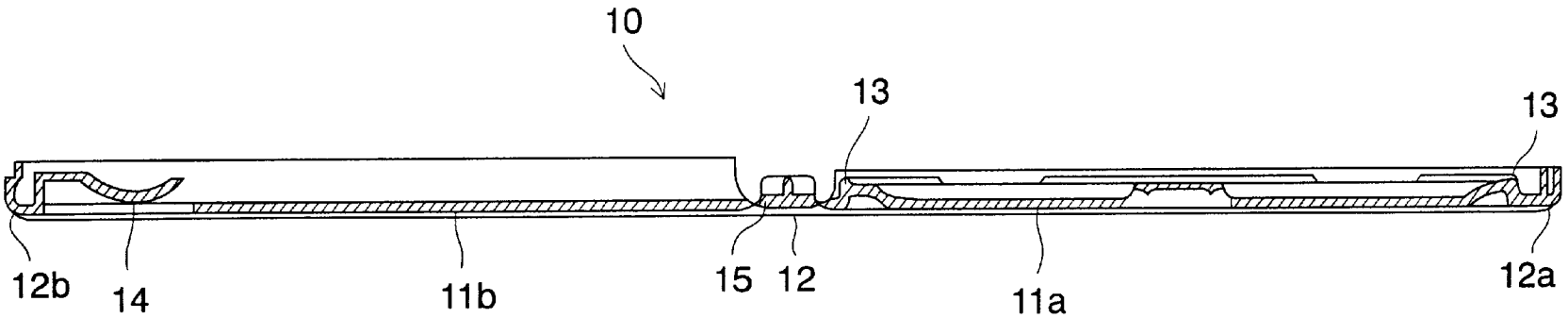
FIG. 6 is a cross sectional view of FIG. 4 taken along line VI—VI.

Referring now to the drawings, FIGS. 4–6 illustrate a case which is used in the card casting method of the present invention. As shown in FIGS. 4–6, a case 10 comprises a case body 11 having a pair of case bodies 11*a* and 11*b* openable and closable via a hinge 15 and a cover 12 attached on the front side of the case body 11. On the case body 11*a* are formed a plurality of ridge portions 13 extending circumferentially. These ridge portions 13 form a loading hole for an optical disk (not shown). On the case body 11*b* are provided a pair of engaging claws 14 to hold a description for the optical disk. After the description is inserted into and engaged with the engaging claws 14, a card is cast or thrown into the case body 11. Both ends 12*a* and 12*b* of the cover 12 are heat-sealed to the end portions of the case bodies.

Figure 1:
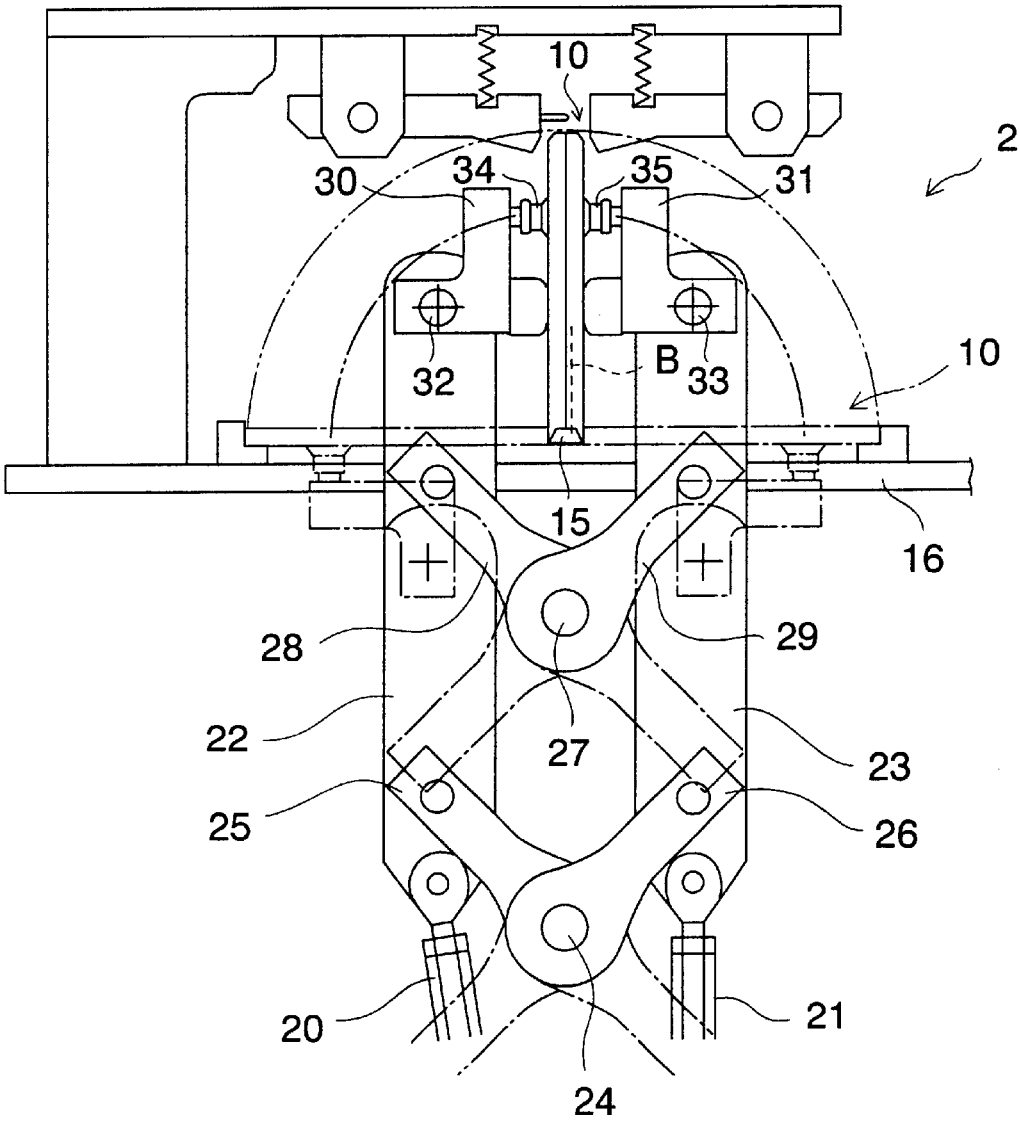
FIG. 1 is a schematic illustrating the case closing device of the card casting machine of one embodiment of the present invention.
Figure 2:
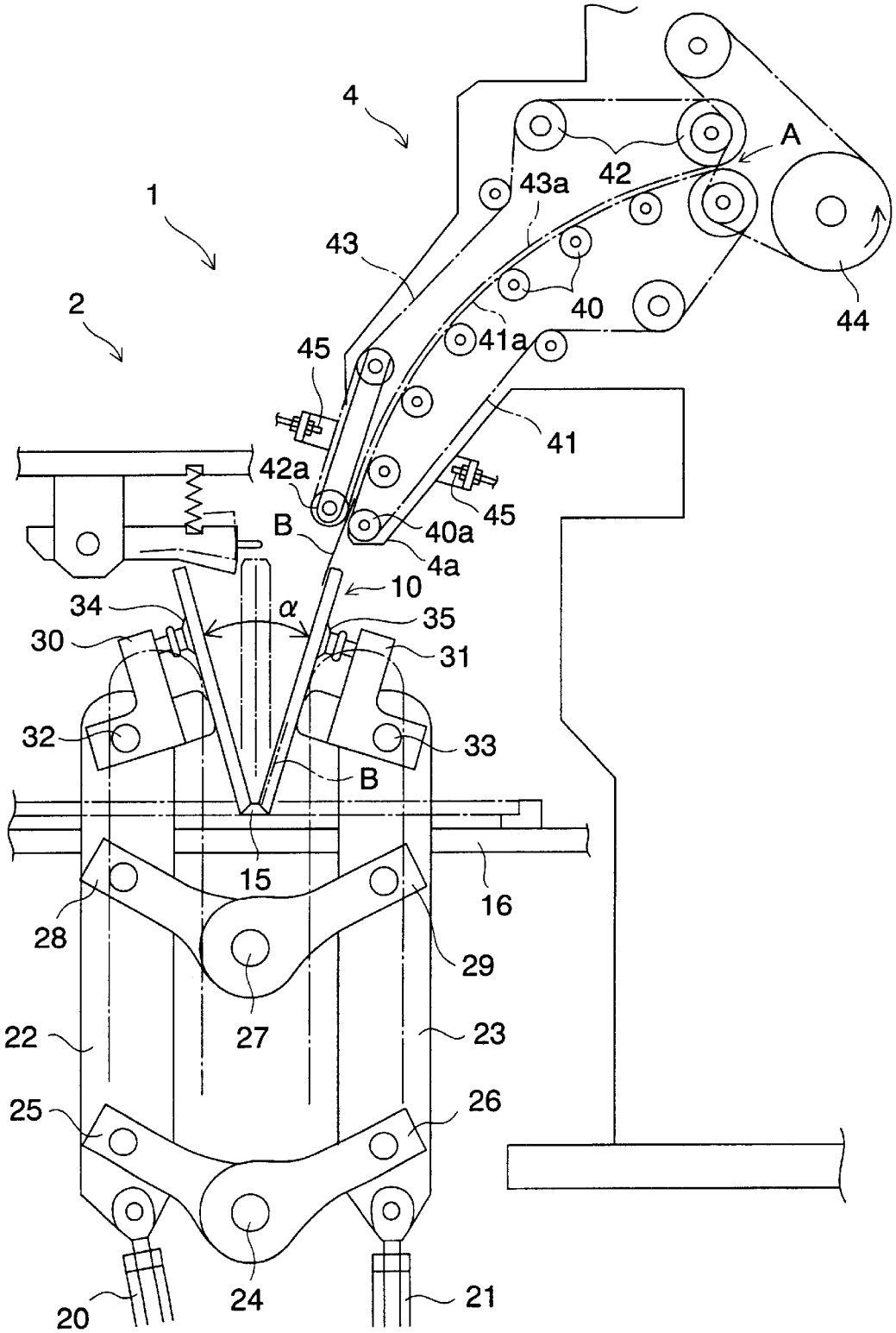
FIG. 2 is a schematic illustrating the card casting device along with the case closing device of the card casting machine of FIG. 1.

As shown in FIGS. 1 and 2, a card casting machine 1 comprises a case closing device 2 to close a case 10 placed on the table 16 in a developed state, and a card casting device 4 to cast or throw a card B into the case 10 when the case closing device 2 closes the case 10.

The case closing device 2 includes a pair of vertically moving members 22 and 23, which are respectively connected to the distal ends of a pair of connecting rods 20 and 21, extending vertically. With the lower portions of the moving member 22, 23 are connected the ends of links 25 and 26 that are rotatably linked via a pin 24. With the upper portions of the moving members 22, 23 are connected the ends of links 28 and 29 that are rotatably linked via a pin 27.

Also, with the upper ends of the moving members 22, 23 are connected L-shaped rotatable blocks 30 and 31 via pins 32 and 33. The rotatable blocks 30, 31 have suction cups 34, 35, respectively, attached thereto to hold a case 10.

Figure 3:
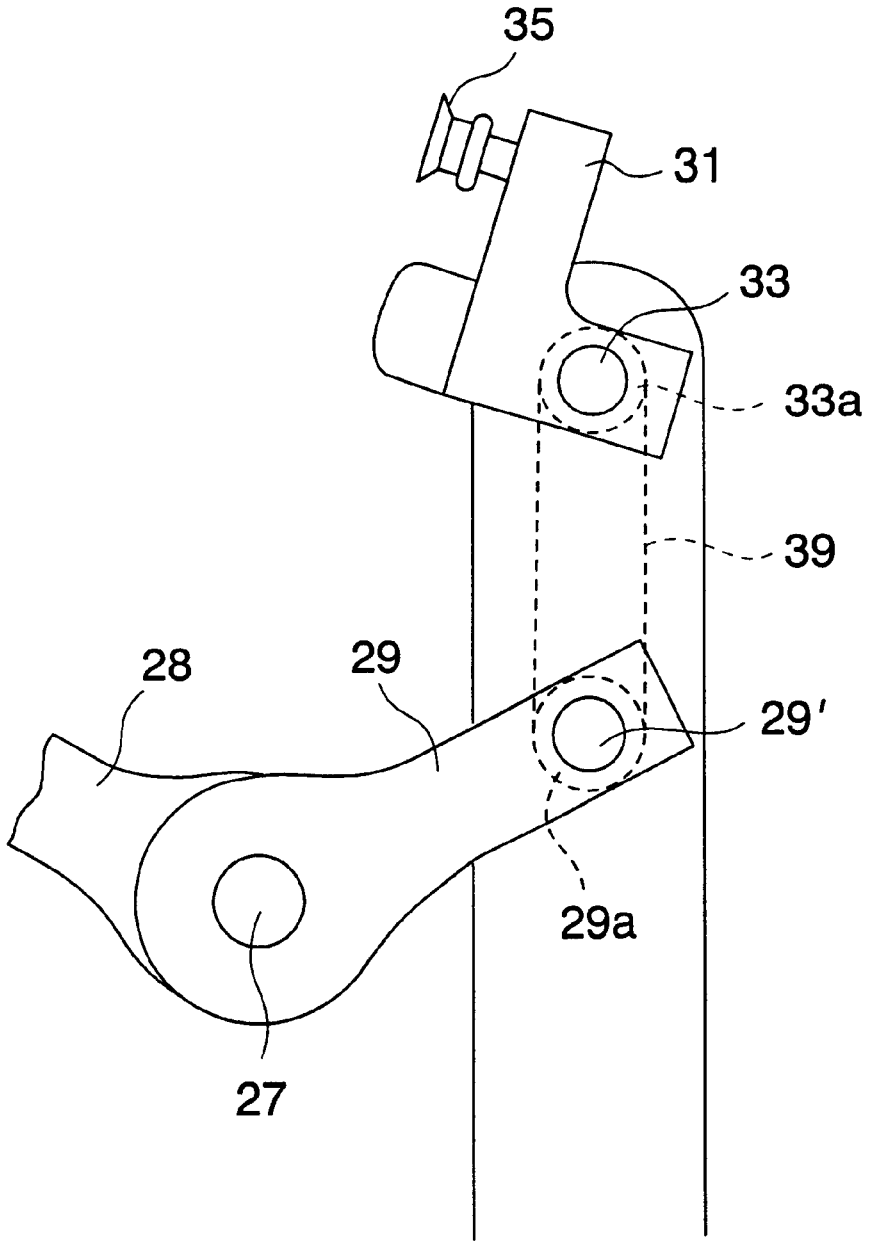
FIG. 3 is an enlarged view of a portion of FIG. 2.

As shown in FIG. 3, a pulley 29*a* is fitted on a pin 29' fixed at the end of the link 29, and a pulley 33*a* is fitted on a pin 33 fixed at the rotatable block 31. A timing belt 39 is wrapped around these pulleys 29*a* and 33*a*. Thereby, rotation of the link 29 causes the rotation of the rotatable block 31 via the timing belt 39. These pulleys and timing belt are also provided on the side of the link 28 and the rotatable block 30.

The card casting device 4 includes a belt 41 wrapped around a plurality of pulleys 40, and a belt 43 having a carrier face 43*a* travelling oppositely to a carrier face 41*a* of the belt 41 and wrapped around a plurality pulleys 42. The belts 41 and 43 are driven by a belt wrapped around a pulley 44, which is driven by a servomotor (not shown). At the upstream ends of the carrier faces 41*a*, 43*a* of the belts 41, 43 is provided a supply portion A where a card loaded in a magazine (not shown) is supplied. At the lower portion of the card casting device 4 is provided a sensor 45 to detect a card B, which has been conveyed by the belts 41, 43.

Now, the card casting method by the aforementioned card casting machine will be described hereinafter.

A card B supplied to the supply portion A of the card casting device from the magazine (not shown), is sandwiched between the carrier faces 41*a*, 43*a* of the belts 41, 43, and is carried by the moving belts 41, 43 in the downstream direction (or diagonally in the downward direction of FIG. 2) by the driving effect of a servomotor (not shown). When the sensor 45 detects a card B transferred to the distal end 4*a* of the card casting device 4, the servomotor stops after delivering a predetermined feed. Thus, the card B stops when it is sandwiched between the rollers 40*a*, 42*a*, and the tip of the card B is protruding beyond the distal end 4*a*.

On the other hand, the moving members 22, 23 of the case closing device 2 move downward, and the front side of a case 10 developed on the table 16 is held by the suction cups 34, 35.

In this condition, when thereafter the connecting rods 20, 21 are lifted upwardly, the moving members 22, 23 move upwardly through the link mechanism with the links 25, 26, 28 and 29. Then, the rotatable blocks 30, 31 interlock or work with the rotational movements of the links 28, 29 through the above-mentioned interlocking mechanism with the pulleys 29*a*, 33*a* and the timing belt 39. Thus, each of the suction cups 34, 35 moves along a locus shown in the double dotted line of FIG. 1. As a result, each case body 11*a*, 11*b* of a case 10 is lifted upwardly and the case 10 begins to close about the hinge 15.

In this case closing process, when an open angle of a case 10 is α (see FIG. 2), the tip of the card B, which has been sandwiched between the lowest rollers 40*a*, 42*a* of the card casting device 4, is placed inside the case body. At this time, the open angle α is an acute angle. Then, by driving the servomotor to cause the belts 41, 43 to travel, the card B sandwiched between the rollers 40*a*, 42*a* is cast or thrown into the case 10. The card B in the case 10 moves downwardly in the card inserting space of V-shaped cross section formed between the case bodies, and drops onto the hinge 15. Thereby, the card B is inserted into the case 10, shown in the dashed line of FIG. 2.

After the card B having been cast into the case 10, the members 22, 23 move further upward and the case 10 is closed, shown in the solid line of FIG. 1 and the dashed line of FIG. 2. In the above-mentioned case closing process, the closing action of a case 10 is continuously performed from the developing condition to the closing condition without stopping the closing action of the case 10 at the open angle α.

According to this embodiment, because the case 10 is open in a V-shaped form at the time of casting a card B, the card B cast into the case 10 drops toward the lower space via its self weight and is placed in the case 10. Thereby, the card B can be prevented from being placed on both the case bodies, and thus, the bending of the card B can be prevented at the time closing the case 10.

Moreover, because the card insertion space of V-shaped cross section formed in the case 10 is narrower as it goes to the lower position or to the hinge 15, the card B cast into the case 10 can be prevented from slipping out of the case 10 and thus, sandwiching or pinching of the card B can be prevented at the time of folding the case 10. In such a way, the card B can be stably and securely cast and inserted into the case 10.

Furthermore, as explained above, prior to casting the card B into the case 10, the card B to be cast stands by at a position passing the distal end 4*a* of the card supply portion 4 and hanging from the distal end 4*a*. Thus, when the case 10 has closed to the open angle α, the tip of the card B is disposed inside one of the case bodies, which causes the card B to be cast into the case 10 more securely.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A method of casting a card into a case that includes first and second case bodies pivotably connected to each other by a hinge, comprising the steps:

a) providing said case in an open condition in which said first and second case bodies are pivotally opened and separated from each other about said hinge;

b) closing said case from said open condition by pivoting at least one of said case bodies toward another of said case bodies about said hinge;

c) casting a card into said case during said step of closing said case, when an open angle defined between said case bodies relative to each other about said hinge is an acute angle, while continuously carrying out said closing without stopping at said acute angle.

2. The method according to claim 1, wherein said pivoting of at least one of said case bodies comprises lifting said at least one of said case bodies relative to said hinge.

3. The method according to claim 1, wherein said pivoting of at least one of said case bodies comprises pivoting both of said case bodies in unison respectively toward each other about said hinge.

4. The method according to claim 1, wherein said step of providing said case comprises supporting said case in said open condition on a support member.

5. The method according to claim 4, wherein said support member is a flat planar support table, and said supporting of said case on said support member comprises laying said case flat on said support table.

6. The method according to claim 1, wherein said first and second case bodies are oriented flat and spread diametrically opposite each other about said hinge in said open condition.

7. The method according to claim 1, further comprising presenting and holding said card in a standby position in which a leading edge of said card extends between said first and second case bodies when said case is being closed and said open angle is said acute angle.

8. The method according to claim 1, wherein said step of casting said card comprises casting said card downwardly so that said card falls downwardly into said case toward said hinge due to gravity acting on said card's own weight.

9. The method according to claim 1, wherein said step of casting said card comprises casting said card into a V-shaped space between said first and second case bodies toward said hinge, such that a leading edge of said card contacts and stops against said hinge.

10. An apparatus for casting a card into a case that includes first and second case bodies pivotably connected to each other by a hinge, said apparatus comprising:

a support member adapted to support the case thereon in an open condition in which the first and second case bodies are pivotally opened and separated from each other about the hinge;

a case closing device adapted to close the case from the open condition by lifting the case bodies of the case that is supported on said support member toward each other; and a card casting device adapted to cast the card into the case during a case closing operation of said case closing device when an open angle defined between the case bodies relative to each other about the hinge is an acute angle;

wherein said case closing device is adapted and controlled to operate and does operate so that said case closing operation of said case closing device is performed continuously without stopping at the acute angle.

11. The apparatus according to claim 10, wherein said support member is a flat planar support table.

12. The apparatus according to claim 10, wherein said card casting device is controlled and adapted to operate and does operate to present and hold the card at a standby position in which a leading edge of the card extends into the case between the first and second case bodies when the case is being closed and the open angle is the acute angle.

13. The apparatus according to claim 10, wherein said case closing device comprises:

two moving members that are connected to each other by pivot links such that said moving members move laterally together or apart relative to each other as said moving members are moved upwardly or downwardly;

respective rotatable blocks that are respectively mounted pivotably on said moving members;

respective suction cups that are mounted on said rotatable blocks and that are adapted respectively to suction-hold the first and second case bodies; and a rotational drive connection between said pivot links and said rotatable blocks such that said rotatable blocks are pivoted as said moving members are moved upwardly or downwardly.

14. The apparatus according to claim 10, wherein said card casting device comprises two circulatable belts respectively supported on two sets of rollers, and a drive motor that drives said belts, wherein said belts are arranged and adapted to transport the card therebetween.

* * * * *